US006444074B1

(12) United States Patent
Marega et al.

(10) Patent No.: US 6,444,074 B1
(45) Date of Patent: Sep. 3, 2002

(54) METHOD FOR THE MANUFACTURE OF FOOTWEAR HAVING A REINFORCED UPPER

(75) Inventors: Antonello Marega, Volpago del Montello; Franco Bonsembiante, Crocetta del Montello, both of (IT)

(73) Assignee: Tecnica SPA, Treviso (IT)

( * ) Notice: Subject to any disclaimer, the term of this patent is extended or adjusted under 35 U.S.C. 154(b) by 0 days.

(21) Appl. No.: 09/589,875

(22) Filed: Jun. 9, 2000

(30) Foreign Application Priority Data

Jul. 11, 1999 (EP) ..... 99830359

(51) Int. Cl.[7] ..... A43D 44/00

(52) U.S. Cl. ..... 156/212; 156/219; 156/222; 12/146 CK; 12/142 LC

(58) Field of Search ..... 264/251, 259, 264/244, 257; 156/209, 303.1, 293, 196, 219, 212, 222; 36/84, 87, 88, 117.1, 45, 46.5, 47, 50.5, 50.1, 51; 12/146 C, 142 LL, 146 CK, 142 LC

(56) References Cited

U.S. PATENT DOCUMENTS 3,483,638 A 12/1969 Baso
3,785,900 A * 1/1974 Gras ..... 156/245
4,642,913 A * 2/1987 Hase et al. ..... 36/50.1
6,029,376 A * 2/2000 Cass ..... 36/50.1

FOREIGN PATENT DOCUMENTS

| | | |
|---|---|---|
| AU | 503418 B | 9/1979 |
| DE | 2812760 B | 7/1979 |
| FR | 1182409 A | 6/1959 |

* cited by examiner

*Primary Examiner*—Michael W. Ball
*Assistant Examiner*—Barbara J. Musser
(74) *Attorney, Agent, or Firm*—Birch, Stewart, Kolasch & Birch, LLP

(57) ABSTRACT

An upper material is pressed so as to produce a plurality of separate areas (22) raised relative to the outer face of the upper (10) and corresponding to the mounting positions of lacing hooks or eyes (14), and a plastics material having good flexibility and resistance to tension and bending is joined to the rear face of the upper material to produce a semi-finished upper which gives rise, in the final footwear, to greater softness and to an improved ability of the upper to bend in response to the stresses applied to the upper by the foot in use in the regions interposed between those in which the lacing eyes or hooks (14) are fixed.

6 Claims, 3 Drawing Sheets

Figure 1:
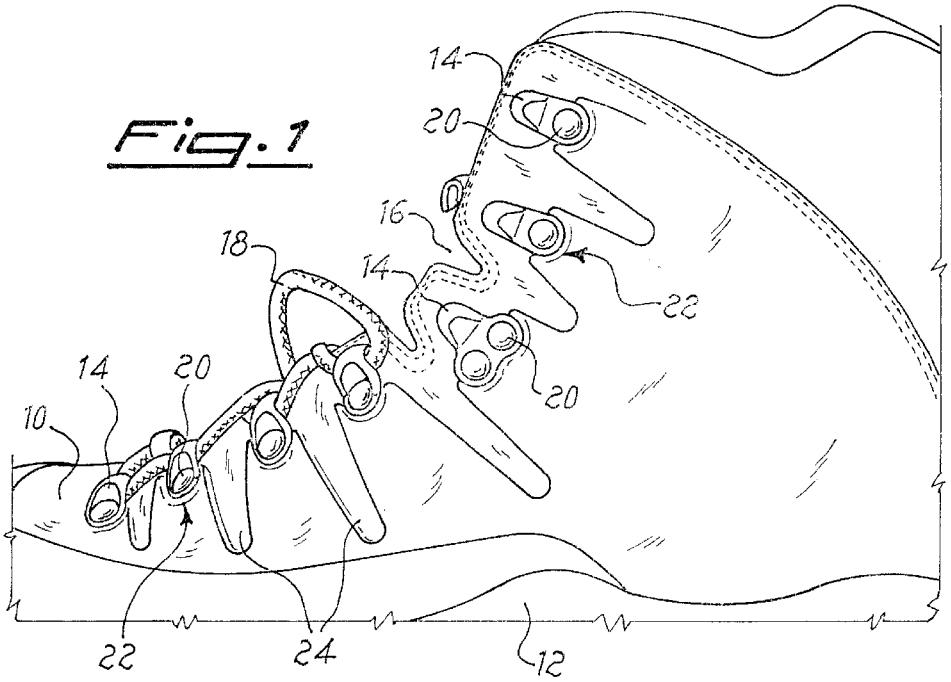

14
20
16
18
14
22
20
14
20
10
22
24
12

20
14
16
18
14
14
20
24
22
24
14
20
10
22
24

METHOD FOR THE MANUFACTURE OF FOOTWEAR HAVING A REINFORCED UPPER

The present invention relates to footwear with lace fastening and a reinforced upper, to a method of manufacturing reinforced uppers for such footwear, and to the upper itself in the semi-finished form. As is well known, an item of footwear comprises basically an upper, that is, the portion which envelops the upper portion of the foot, reaching from the toe to the heel, a sole, to which the upper is fixed along its lower edge, and a so-called heel element which completes the rear portion of the footwear, actually in the heel region.

In many types of footwear the upper also has a front opening through which the foot is inserted and which is normally equipped with a protective tongue and closed by a lace by means of eyes or hooks fixed to the outer surface of the upper along the edges of the opening. Clearly, every time the footwear is laced up the upper is stressed in the region of the eyes or hooks; moreover, in the case of footwear used for certain uses, for example, for sports activities, the lacing, and hence the upper, are also stressed during normal use, again in the region of the eyes or hooks. For this reason, up to now, it has not been possible to make the upper lighter, that is, to reduce its thickness and hence its heaviness; such a reduction would in fact lead to a weakening as a result of which the areas in which the hooks or eyes are fixed would be subject to tearing or breakage. Moreover, the substantial thickness of the upper renders it less flexible in the portions which are bent and stretched alternately when the footwear is in use.

The main object of the present invention is to provide footwear uppers which are thin but which nevertheless retain characteristics of strength for the secure fixing of lacing hooks or eyes along the two edges of the opening of the footwear.

Naturally, this object should be achieved in an industrially advantageous manner.

A further object of the present invention is to provide an upper which enables the foot to be enveloped better in the resulting footwear and which permits improved articulation of the upper in the regions interposed between the fixing positions of the lacing eyes or hooks.

It has now been found and constitutes the subject of the present invention that this and other objects are achieved by footwear having an opening with lace fastening, the upper of the footwear being produced by a method for its manufacture which is characterized in that the upper material is subjected to a pressing step in which a plurality of separate areas, raised relative to the outer face of the upper and corresponding to the mounting positions of the lacing hooks or eyes, are produced, and to a step for joining at least one layer of reinforcing material to the rear face of the upper material, the reinforcing material being applied in the region of the said raised areas of the upper in which the lacing hooks or eyes are to be mounted, and preferably extending to the portions of the surface of the upper material adjacent the said raised areas.

In the preferred embodiment of the method of the present invention, the upper material, which may be natural leather or synthetic material of the types normally used for uppers, is thinner than that normally used for an upper and the reinforcing material is joined to the inner face of the upper material simultaneously with the pressing step.

The pressing step and the step for the joining of the reinforcing material are preferably performed by means of a suitably shaped die and matrix unit under an appropriate pressure and at a temperature suitable for the type of material constituting the upper.

For example, for a leather upper, the pressing temperature is of the order of 160° C. and the pressing pressure is about 9.8–29.4 KPa (10–30 kg/cm$^2$).

The reinforcing material in turn is usually a plastics material which has good flexibility and resistance to tension and bending, preferably in the form of fibers impregnted with resin such as, for example, polyester, acrylic, carbon or glass fibers impregnated with a thermosetting resin.

The resin is preferably selected from polyurethane and acrylic resins.

The thickness of the reinforcing material in turn is between 0.5 and 3 mm.

The rear face of the upper may be joined in other regions to other lining materials having specific properties according to the desired functions.

For example, in the toe region of the footwear, the upper may be lined with a material which confers stiffness and/or may be waterproof and/or thermally insulating. The use of thermosetting resins such as polyurethane and acrylic resins is envisaged for this purpose.

As can be appreciated from the following description of a preferred embodiment, the present invention enables the thickness of the upper to be reduced by about 30% in comparison with the thicknesses usually used, achieving a clear advantage in terms of costs.

Moreover, with the present invention, particularly in the case of uppers made of leather or of a synthetic material of considerable stiffness, the reduction in thickness achieves a greater softness which is accompanied by a greater ability of the material to bend in response to the stresses applied to the upper by the foot when the footwear is in use. This achieves greater comfort for the user which is a very important aspect for footwear in general and even more so for sports footwear.

The reinforcing material may also be applied in different thicknesses, in the sense that it may have a considerable thickness in the region of the above-mentioned areas in which the hooks or eyes are mounted and may be much thinner, but still suitable for performing a reinforcing function, in the portions of the upper in which the lacing opening is made, so as also to reinforce the upper in the area which is subject to repeated bending when the footwear is in use.

Figure 2:
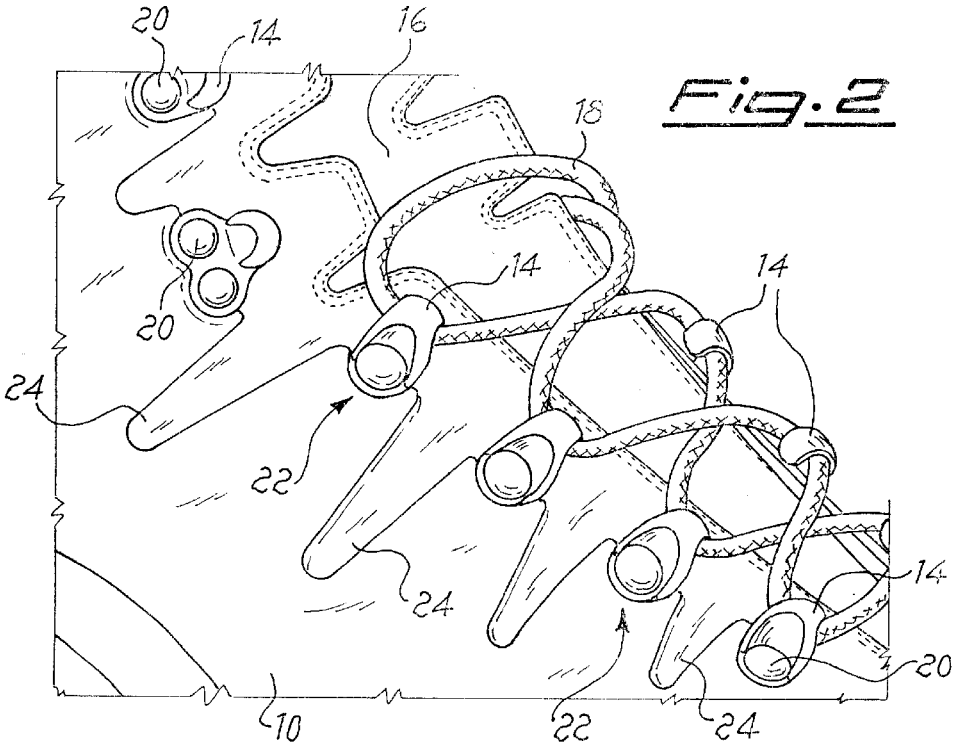
Figure 3:
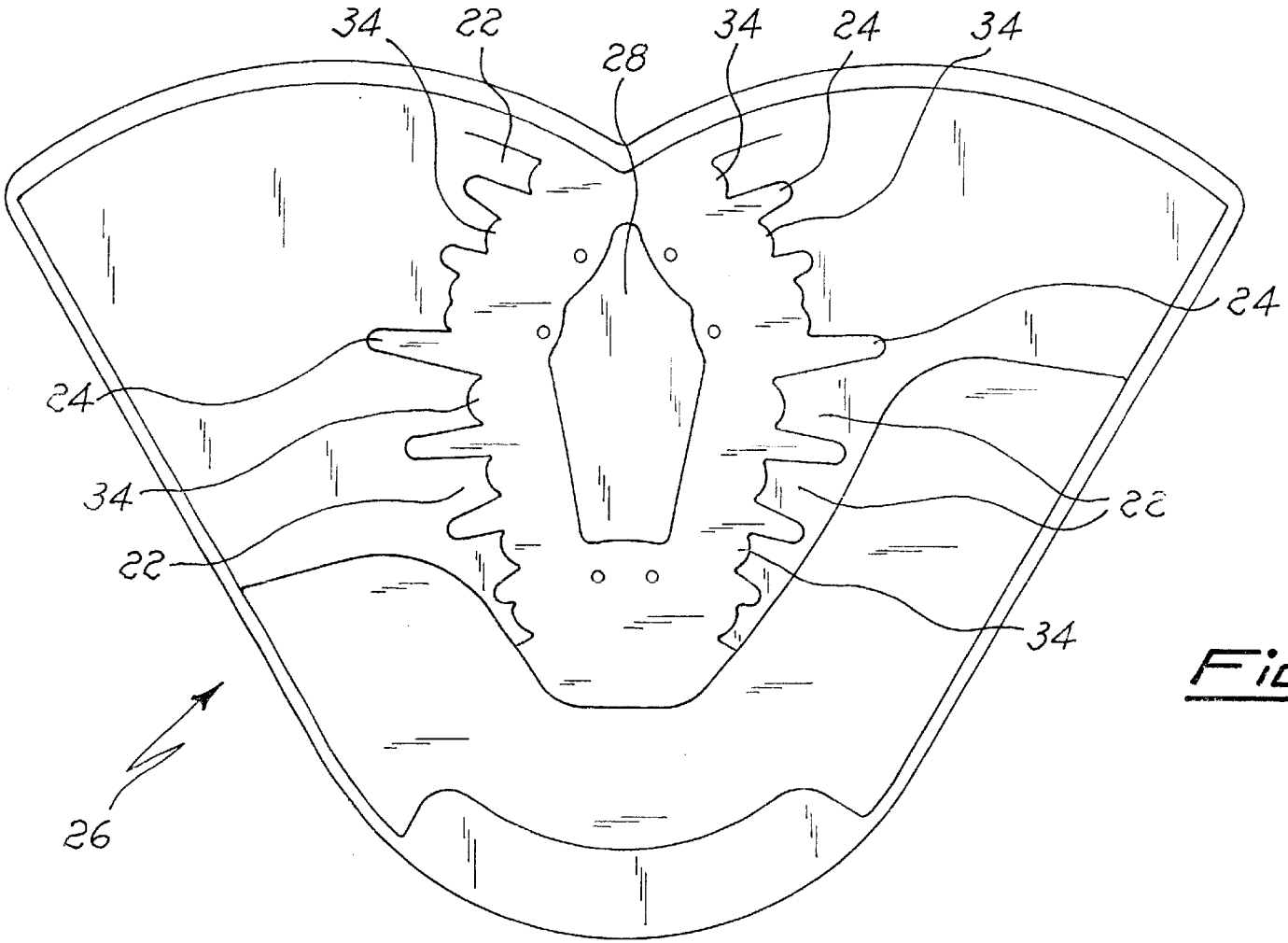
Figure 5:
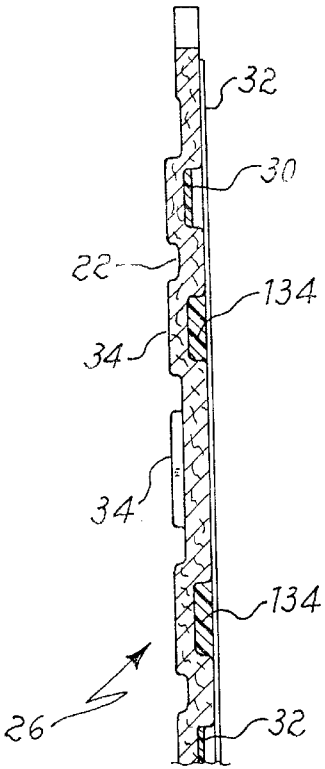
Figure 4:
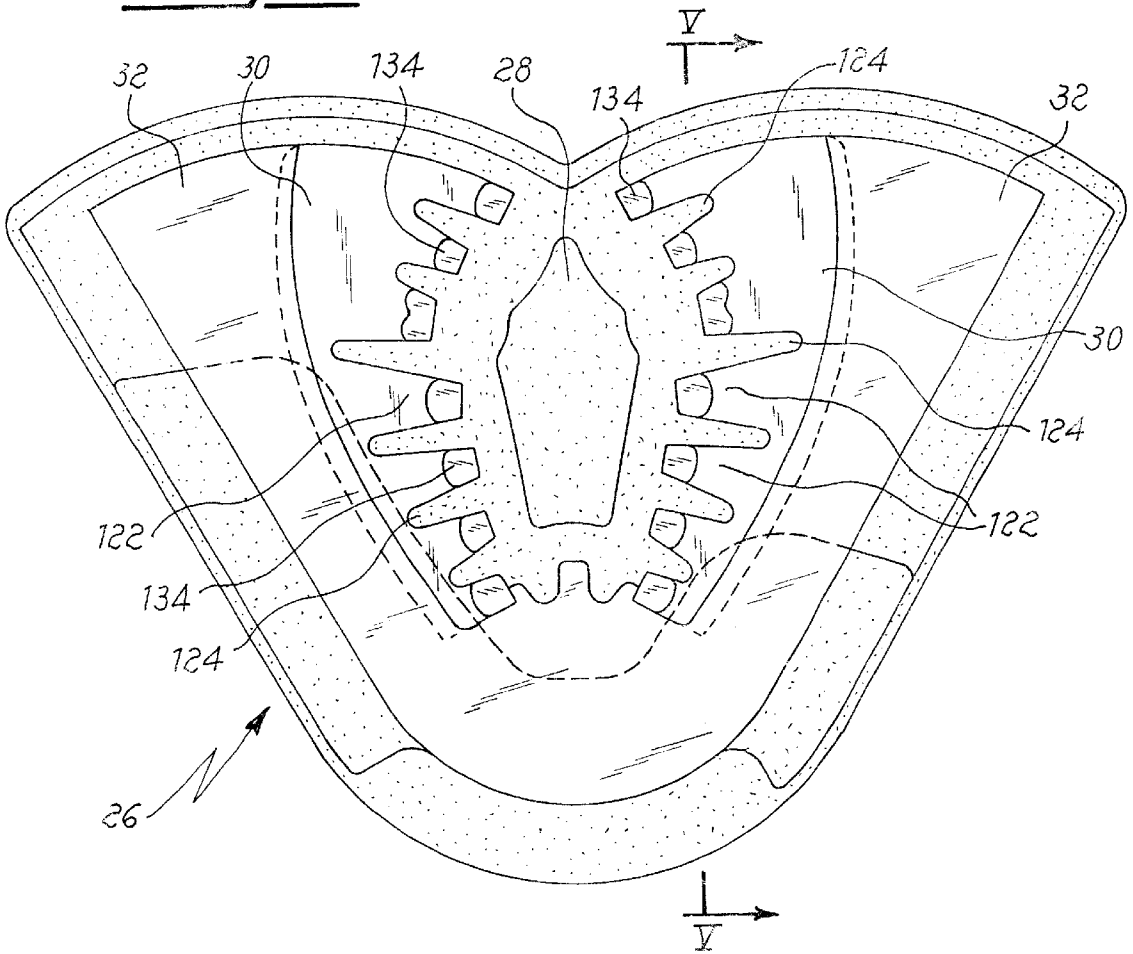

The particular features and the advantages of the present invention will become clearer from the following detailed description, given with reference to the appended drawings, in which:

FIG. 1 is a partial side view of a boot produced with an upper manufactured in accordance with the present invention, FIG. 2 is an enlarged view of a portion of the upper of FIG. 1, FIGS. 3 and 4 are plan views of the outside and of the inside of the upper used to produce the boot of FIGS. 1 and 2, respectively, and FIG. 5 is a section taken in the section plane V—V of FIG. 4.

With reference first of all to FIGS. 1 and 2, a boot, shown partially and formed in accordance with the present invention, comprises an upper 10 and a sole 12. The upper has a front opening 16 which is covered by a tongue (not shown) and which can be closed in the usual manner by means of a fastening with a lace 18. The two edges of the opening 16 are equipped with hooks 14 which are engaged by two portions of the lace 18 disposed in a crossed arrangement.

In FIGS. 1 and 2, it can clearly be seen that the bases of the hooks 14 are fixed to the outer or visible surface of the upper 10 by means of rivets 20 and, in particular, that, in the region of the fixing position of each rivet 20, the upper 10 has a raised portion or area 22 which is shaped so as to form a curved portion which partially surrounds the respective rivet 20.

Moreover, the raised areas 22 are separated by apparently recessed areas 24 which, although they appear recessed, in fact lie in the plane of the remaining portion of the upper 10.

Turing now to FIGS. 3 and 4, these show the semi-finished product 26 from which the upper 10 is produced during the manufacture of the above-described boot; FIG. 3 shows, in plan, the face of the semi-finished product which is to form the outer portion of the boot upper, whereas FIG. 4 shows its inner face.

In FIGS. 3 and 4, the central portion, which is cut, for example, by die-shutting to form the front opening 16 of the boot during the production of the upper 10, is indicated by 28.

In FIG. 4, the reference numerals of FIG. 3, increased by 100, indicate the corresponding elements which are distinguished by the fact that the recessed areas 122 correspond to the raised areas 22 of FIG. 3 and the raised areas 124 correspond to the portions 24 of FIG. 3.

In FIG. 4, the arrangement and shape of the reinforcing material 30 which substantially contributes to the strength of the two bands of the upper adjacent the front opening can also be appreciated.

A further material which, however, serves to line the inner face of the semi-finished product 26 and hence of the upper 10 is indicated 32.

As already mentioned, the materials forming the reinforcing layer 30 and the lining material 32 are selected in dependence on the properties desirable in the individual upper portions. Moreover, the locations in which fixing positions 34 for the rivets 22 of the lacing hooks 14 are provided on the opposite face (see FIG. 3) are indicated 134 in FIG. 4.

As already mentioned above, lacing eyes may be provided instead of the hooks 14 and, in addition to the front lacing position, footwear with side lacing is also provided for.

In this case, the arrangement of the raised areas and of the rear reinforcement will be different. The invention has been described with reference to a preferred embodiment but conceptually and structurally equivalent modifications and variations are possible and foreseeable, without departing from its scope.

For example, other production processes are possible instead of hot pressing by means of a die and a matrix.

In particular, when the upper is not made of natural leather but of syntic material, the raised and recessed areas may be produced directly during the production of the upper material, that is, without the need for the pressing step which is necessary in the case of upper already existing material such as natural leather.

Moreover, both with natural leather and with uppers made of synthetic material, differentiated thicknesses of the reinforcing material may also be used.

What is claimed is:

1. A method of manufacturing semi-finished uppers of footwear, a visible face of an upper being formed from a single sheet of a material selected from at least one of natural leather and a synthetic upper material, said method comprising the steps of:

(a) joining at least one layer of a reinforcing material to a plurality of separate parts of a rear face of the single sheet to form a plurality of reinforced separate parts; and (b) pressing the single sheet having the reinforced separate parts to produce a plurality of raised areas on the visible face of the upper, said raised areas corresponding to a plurality of mounting positions and to said reinforced separate parts in a finished footwear product.

2. A method of manufacturing semi-finished uppers according to claim 1, wherein the pressing step is performed with a die and a matrix.

3. A method of manufacturing semi-finished uppers according to claim 2, wherein the joining step is performed simultaneously with the pressing step.

4. A method of manufacturing semi-finished uppers according to claim 1, said single sheet being made of synthetic upper material, wherein the pressing step is performed during a stage of the manufacture of the synthetic upper material itself.

5. A method of manufacturing semi-finished uppers according to claim 1, said single sheet being made of a natural leather upper, wherein the pressing step is performed at a temperature of 160° C. and at a pressure of between 9.8 and 29.4 Kpa (10 and 30 kg/cm$^2$).

6. A method of manufacturing semi-finished uppers of footwear, said method comprising the steps of:

(a) forming an upper having a visible face, a rear face and a front opening from a single sheet of a material selected from a natural leather or a synthetic upper material;

(b) joining at least one layer of a reinforcing material to a plurality of separate parts of the rear face of the single sheet to form a plurality of reinforced separate parts; and (b) pressing the single sheet having the reinforced separate parts to produce a plurality of raised separate areas on the visible face of the upper, said raised separate areas corresponding only to a plurality of mounting positions and to said reinforced separate parts for at least one of lacing hooks or eyes of a finished footwear product.

* * * * *